United States Patent [19]

Kubozuka et al.

[11] 4,456,092

[45] Jun. 26, 1984

[54] NOISE-SHIELDING PANEL FOR ENGINE

[75] Inventors: Takao Kubozuka, Yokosuka; Naoki Ogawa, Yokohama; Hideya Yamaguchi, Yokosuka, all of Japan

[73] Assignee: Nissan Motor Co., Ltd., Yokohama, Japan

[21] Appl. No.: 300,986

[22] Filed: Sep. 10, 1981

[30] Foreign Application Priority Data

Sep. 22, 1980 [JP] Japan ..... 55-135109[U]

[51] Int. Cl.[3] ..... E04B 1/82

[52] U.S. Cl. ..... 181/290; 181/204; 181/294

[58] Field of Search ..... 181/204, 207, 205, 202, 181/284, 294, 290; 123/198 E

[56] References Cited

U.S. PATENT DOCUMENTS 4,037,521 7/1977 McLeod ..... 181/204 X
4,048,366 9/1977 Kingsbury ..... 123/198 E X
4,269,287 5/1981 Rosch .

FOREIGN PATENT DOCUMENTS 177289 6/1953 Fed. Rep. of Germany .
6916548 4/1969 Fed. Rep. of Germany .
2848503 5/1980 Fed. Rep. of Germany .
2443576 7/1980 France .
2005191 4/1979 United Kingdom .

OTHER PUBLICATIONS

Automobiltechnische Zeitschrift, vol. 80, No. 6, "Neue Schallschluckelemente von Freudenberg", p. 294 (Jun. 1978).

Automotive Engineering, vol. 88, No. 1, "Plastic Oil Pan", p. 96 (Jan. 1980).

Patent Abstracts of Japan, vol. 4, No. 84, p. 97M16 (Jun. 1980).

*Primary Examiner*—Benjamin R. Fuller

*Attorney, Agent, or Firm*—Schwartz, Jeffery, Schwaab, Mack, Blumenthal & Koch

[57] ABSTRACT

A noise-shielding panel comprises a flat section spacedly disposed from the surface of an engine body and formed of a fibrous composite, and a contacting section integral with the flat section and formed of the same fibrous composite as in the flat section. The contacting section is in direct contact with the engine body surface and lower in density of the fibrous composite than the flat section, thereby facilitating production thereof and exhibiting a high noise-shielding effect.

13 Claims, 8 Drawing Figures

PRIOR ART FIG. 1
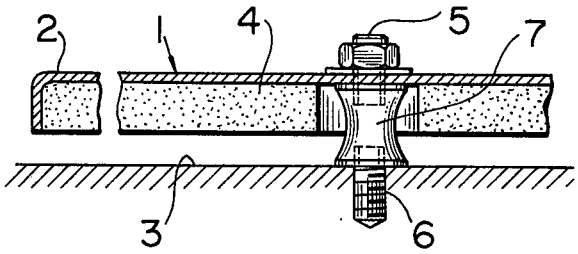
PRIOR ART FIG. 2
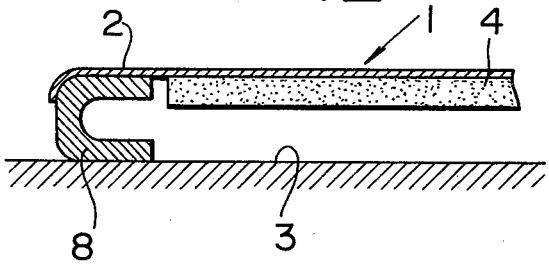
FIG. 3
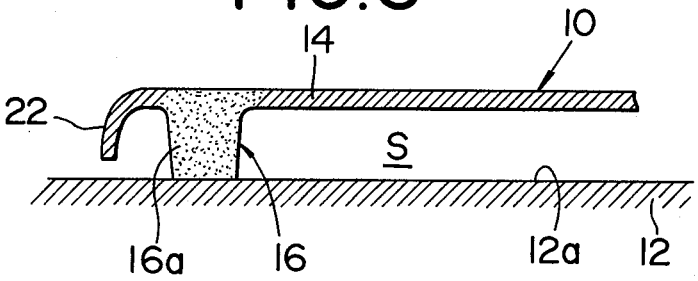
FIG. 4
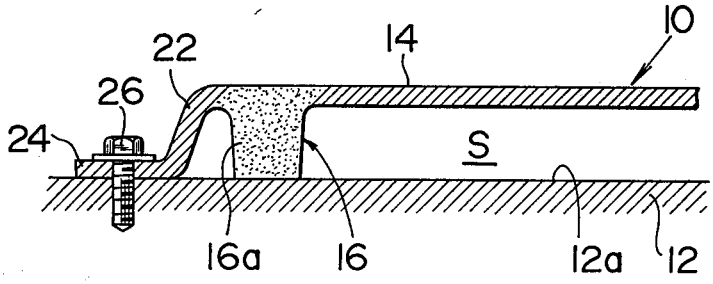

NOISE-SHIELDING PANEL FOR ENGINE

BACKGROUND OF THE INVENTION

1. Field of the Invention

The present invention relates to a noise-shielding panel for preventing noise radiation from the surface of an engine body of an automotive vehicle or the like.

2. Description of the Prior Art

In connection with automotive vehicles, it has been proposed to provide noise-shielding panels on the surface of an engine body to prevent engine noise from radiating outside. Such noise-shielding panels are usually constructed of a steel plate and a sound-absorbing material attached to the inner surface of the steel plate. The noise-reducing panel is elastically installed on the surface of the engine body through elastomeric members. However, such a noise-shielding panel is complicated in construction and accordingly difficult to produce, thereby making production cost high.

BRIEF SUMMARY OF THE INVENTION

In accordance with the present invention, a noise-shielding panel comprises a flat section disposed spaced from the surface of an engine body and formed of a fibrous composite. The panel further comprises a contacting section integral with the flat section and formed of the same fibrous composite as in the flat section. The contacting section is in direct contact with the engine body surface to support therethrough the flat section on the engine body surface and to maintain a seal between the flat section and the engine body surface. Additionally, the contacting section is lower in density of the fibrous composite than the flat section.

Such a noise-shielding panel is produced in a single piece by merely press-forming a single material (fibrous composite) into in a desired shape, thereby facilitating the production thereof and lowering the production cost thereof. Of course, the noise-shielding panel according to the present invention is high in noise-shielding effect as compared with conventional ones.

BRIEF DESCRIPTION OF THE DRAWINGS

The features and advantages of the noise-shielding panel according to the present invention will be more appreciated from the following description taken in conjunction with the accompanying drawings in which like reference numerals designate the corresponding parts and elements, and in which:

FIG. 1 is a cross-sectional view of a part of a conventional noise-shielding panel;

FIG. 2 is a cross-sectional view of another part of the conventional noise-shielding panel;

FIG. 3 is a cross-sectional view of a part of a noise-shielding panel in accordance with the present invention;

FIG. 4 is a cross-sectional view similar to FIG. 3, but showing another part of the noise-shielding panel in accordance with the present invention;

DETAILED DESCRIPTION OF THE INVENTION

Figure 6:
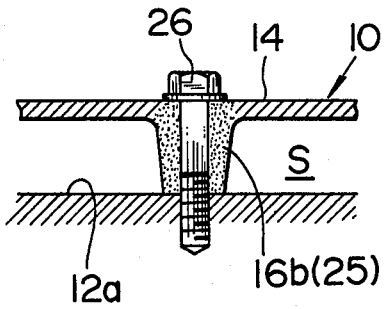
FIG. 6 is a cross-sectional view of a modified example of the noise-shielding panel according to the present invention.

To facilitate understanding the present invention, a brief reference is made to a conventional noise-shielding panel, depicted in FIGS. 1 and 2. Referring now to FIGS. 1 and 2, a conventional noise-shielding panel 1 is shown having a steel plate 2 which is spacedly disposed from the surface 3 of an engine body. A sound absorbing material 4 is securely attached or bound to the inner surface of the steel plate 1 to improve the sound absorbing effect of the noise-shielding panel. The noise-shielding panel 1 is elastically supported on the engine body surface 3 by means of stud bolts 5, 6 which are connected with each other through an elastic or elastomeric material 7 so that the vibration input from the engine body surface 3 can be absorbed by the elastic material, thereby preventing noise generation due to the vibration of the noise-shielding panel 1 itself. Additionally, in order to easily carry the sound absorbing material and improve noise shielding ability, the peripheral section of the metal plate 2 is bent as shown in FIG. 1. To further improve the noise shielding ability of the noise-shielding panel at the peripheral section, an elongate elastic material 8 having a C-shaped cross-section may be securely attached to the peripheral section of the metal plate 2 as shown in FIG. 2.

However, the above-mentioned conventional noise-shielding panel has encountered the following difficulties: The adhesion of the sound absorbing material is unavoidably necessary and the stud bolts with the elastic material must be used. This renders the structure of the noise-shielding panel complicated and production thereof difficult, thereby causing high production cost. Additionally, the sealing ability of the elastic material having the C-shaped cross-section to the uneven engine body surface is insufficient because of difficulty in producing the elastic member having a low spring constant. Furthermore, no noise-shielding measure has been taken in the noise-shielding panel at the sections through which various brackets and pipings pass.

Figure 5:
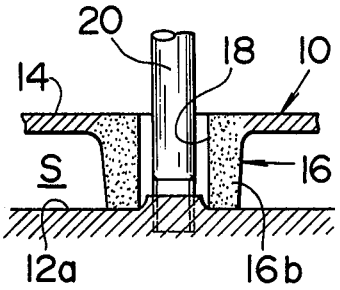
FIG. 5 is a cross-sectional view of a further part of the noise-shielding panel in accordance with the present invention.

In view of the above description of the conventional noise-shielding panel, reference is now made to FIGS. 3 to 8, and more particularly to FIGS. 3, 4, and 5, wherein an embodiment of a noise-shielding panel according to the present invention is illustrated by the reference numeral 10. The noise-shielding panel 10 is attached on the surface **12*a* of an internal combustion engine body 12 (a cylinder block in this instance) which is, for example, used for an automotive vehicle (not shown). This noise-shielding panel 10 comprises a flat or cover section 14 which is spaced a predetermined distance from the engine body surface 12*a*. The flat section 14 is integral with a contacting section 16 through which the noise-shielding panel 10 contacts and is supported on the engine body surface 12*a*. The contacting section 16 includes a sealing portion 16*a* and a boss portion 16*b* which directly contact the engine body surface 12*a*. The sealing portion 16*a* is formed generally in the shape of a band and extends along the whole periphery of the flat section 14 to provide a seal between the flat section 14 and the engine body surface 12*a*. In other words, a sealed space S is defined inside of the sealing portion 16***a* and between the inner surface of the flat section 14 and the engine body surface 12*a*. The boss portion 16*b* is formed generally in the shape of a cylinder which projects from the flat section 14, and accordingly the boss portion 16*b* is formed with a through-hole 18 within which a pipe 20 or the like projection may extend from the engine body surface 12*a*. As shown, the bottom surface of the cylindrical boss portion 16*b* sealingly contacts the engine body surface 12*a* around the projections such as the pipes, so that a tight seal of the noise-shielding panel to the engine body surface 12*a* can be obtained, thereby sealingly confining the space S even though the projections extend from the engine body surface 12*a*. The integral flat and contacting sections 14, 16 are formed of a fibrous composite which will be discussed in detail hereinafter. From the standpoint of obtaining good sealing ability, the contacting section 16 including the sealing and boss portions 16*a*, 16*b* are formed with a lower density of the fibrous composite than the flat section 14.

Figure 7:
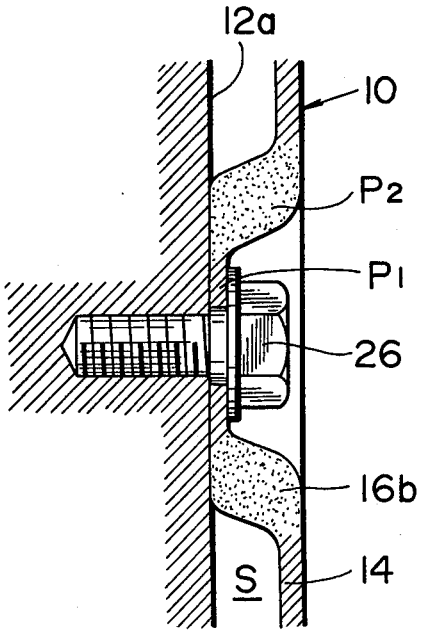
FIG. 7 is a cross-sectional view of another modified example of the noise-shielding panel according to the present invention.
Figure 8:
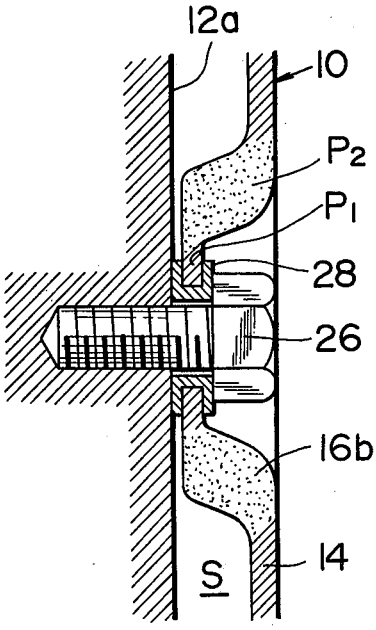
FIG. 8 is a cross-sectional view of a further modified example of the noise-shielding panel according to the present invention.

A cover section 22 is further formed integrally with the sealing portion 16*a* and is bent to protect and cover the sealing portion 16*a*. The cover section 22 is extended outwardly at the suitable locations to form a flange sections 24 as shown in FIG. 4. The noise-shielding panel 10 is securely attached or installed at the flange section 24 onto the engine body surface 12*a* by means of bolts 26. The cover and flange sections 22, 24 are also formed of the above-mentioned fibrous composite same as in the flat and contacting sections 14, 16, and their fibrous composite densities are generally the same as that of the flat section 14, i.e. higher than that of the contacting section 16. The installation of the noise-shielding panel 10 may be otherwise accomplished by using a part of the boss portion 16*b* as an installation boss 25, and attaching the noise-shielding panel at the boss 25 by the bolts 26 passing through the boss 25 as shown in FIG. 6. In this case, there is a possibility that the bolt 26 will damage the boss portion 16*b* (25) since the boss portion 16*b* is relatively low in density. In order to overcome such a problem, it is preferable to make the fibrous composite density high in a portion $P_1$ which directly receives the pressure of the bolt and deforms as shown in FIG. 7. Accordingly, the density of the portion $P_1$ becomes the same as in the flat section 14, thereby rigidly securing installation of the noise-shielding panel to the engine body surface 12*a*. On the contrary, a portion $P_2$ around such a high density portion $P_1$ is made low in density of the fibrous composite to obtain the same low density as in the contacting section 16, thereby attaining a high sound absorbing effect. In order to obtain a further secure fixation and installation of the noise-shielding panel 10, a metallic annular member 28 may be disposed between the generally annular high density portion $P_1$ and the bolt 26. Although the metallic annular member 28 serves as a medium for transmitting sound, the vibration from the bolt 26 is not liable to be transmitted to the flat section 14 because the boss section $P_2$ is sufficiently low in fibrous composite density.

As stated above, the noise-shielding panel is made of the fibrous composite which consists of an organic fiber such as wool, polyester fiber, nylon fiber, or the like; or an inorganic fiber such as rock wool, glass wool, alumina fiber, steel wool, carbon fiber, silicon carbide fiber, or the like. The fibrous composite may consist of some of the above-mentioned fibers. The fibrous composite further consists of a thermosetting resin such as epoxy resin, acrylic resin, phenol resin, or the like, and its cross linking agent such as formalin. Accordingly, in the fibrous composite, the fibers are bounded each other by the thermosetting resin which has undergone its cross linking reaction. The fibrous composite is formed into a one-piece noise-shielding panel 10 including the flat and contacting sections 14, 16 etc by press-forming with heat. In this press-forming, the sealing and boss portions 16*a*, 16*b* are formed lower in density of the fibrous composite than the other sections such as the flat and cover sections 14, 22 and the like, by varying the pressing pressure applied to the surface of the fibrous composite. The density of the portions 16*a*, 16*b* is preferably 1/10 or less of that of the sections 14, 22 and the like.

With the thus press-formed noise-shielded panel, sound absorbing and noise-shielding effects can be highly improved by virtue of the relatively high density flat section 14. Additionally, the relatively low density sealing and boss portions 16*a*, 16*b* (low in spring constant) can provide a good seal between the flat section 14 and the engine body surface 12*a*, thereby further improving the noise-shielding effect of the noise-shielding panel 10. Furthermore, by virtue of the low density of the sealing and boss portions 16*a*, 16*b* which directly contact the engine body surface 12*a*, the vibration from the engine body surface 12*a* cannot be transmitted to the flat section 14, thereby preventing noise generation due to the vibration of the flat section 14 itself. It will be understood that the above-mentioned vibration from the engine body surface 12*a* includes vibration input via the flange section 24. Moreover, since the noise-shielding panel 10 is produced by integrally press-forming a single material (the fibrous composite), it is unnecessary to use the sound absorbing material 4, the stud bolts 5, 6 with the elastic material 7, the frame-like elastic member 8 and the like in the conventional noise-shielding panel shown in FIGS. 1 and 2. In this regard, the noise-shielding panel according to the present invention is relatively easy to produce and accordingly low in production cost.

As appreciated from the above, according to the present invention, the essential functions such as vibration damping and noise-shielding effects of the noise-shielding panel can be attained by merely varying the pressing pressures applied to different sections of the single fibrous composite material during the press-forming operation. Therefore, the noise-shielding panel is improved in its performance, greatly lowering production and material costs, as compared with conventional noise-shielding panels. Besides, the fibrous composite material contributes to lightening the weight of the noise-shielding panel and accordingly engine weight.

What is claimed is:

1. A noise-shielding panel for preventing noise radiation from an engine body surface, comprising:

a flat section spacedly disposed from the engine body surface and formed of a fibrous composite; and a contacting section integral with said flat section and formed of the same fibrous composite as in said flat section, and contacting section being in direct contact with the engine body surface to support therethrough said flat section spaced from the engine body surface and to maintain a seal between said flat section and the engine body surface, said contacting section being lower in density of the fibrous composite than said flat section.

2. A noise-shielding panel as claimed in claim 1, wherein said flat and contacting sections are formed integrally as one-piece by press-forming said fibrous composite.

3. A noise-shielding panel as claimed in claim 1, wherein said contacting section includes a sealing portion whose surface is in direct contact with the engine body surface so as to maintain a seal between the peripheral portion of said flat section and the engine body surface, and a boss portion whose surface is in direct contact with the engine body surface so as to maintain a seal between the engine body surface and said flat section around a projection extended from the engine body surface.

4. A noise-shielding panel as claimed in claim 3, wherein said sealing portion is generally in the shape of a band and formed along the periphery of said flat section to define a sealed space thereinside and between said flat section and the engine body surface.

5. A noise-shielding panel as claimed in claim 3, wherein said boss portion is generally cylindrical having a through-hole in which said projection from the engine body surface is disposed.

6. A noise-shielding panel as claimed in claim 1, wherein said fibrous composite includes at least one member selected from the group consisting of wool, polyester fiber, nylon fiber, rock wool fiber, glass wool (glass fiber), alumina fiber, steel wool, carbon fiber, and silicon carbide fiber.

7. A noise-shielding panel as claimed in claim 6, wherein said fibrous composite includes a thermosetting resin selected from the group consisting of epoxy resin, acrylic resin, and phenol resin.

8. A noise-shielding panel as claimed in claim 1, further comprising a cover section integral with said contacting section and formed of the same fibrous composite as in said flat section, said cover section being higher in density of the fibrous composite than said contacting section, said cover section being located outside of said contacting section and bent to cover said contacting section.

9. A noise-shielding panel as claimed in claim 8, further comprising a flange section integral with said cover section and formed of the same fibrous composite as in said flat section, said flange section being higher in density of the fibrous composite than said contacting section, said flange section extending outwardly from said cover section and being in direct contact with the engine body surface to be secured to the engine body surface by bolts.

10. A noise-shielding panel as recited in claim 3 further comprising a cover section integral with said sealing portion and formed of the same fibrous composite as in said flat section, said cover section being higher in density of the fibrous composite than said contacting section, said cover section being located outside of said sealing portion and bent to cover said sealing portion.

11. A noise-shielding panel as recited in claim 10 further comprising a flange section integral with said cover section and formed of the same fibrous composite as in said flat section, said flange section being higher in density of the fibrous composite than said contacting section, said flange section extending outwardly from said cover section and being in direct contact with the engine body surface to be secured to the engine body surface by bolts.

12. A noise-shielding panel as recited in claim 1 wherein:

said sealing portion is generally in the shape of a band and formed along the periphery of said flat section to define a sealed space thereinside and between said flat section and the engine body surface, and wherein said boss portion is generally cylindrical having a through-hole in which said projection from the engine body surface is disposed.

13. A noise-shielding panel as recited in claim 12 wherein said boss section comprises a flange section immediately adjacent said through-hole, said flange section being integral with said boss section and formed of the same fibrous composite as in said flat section, said flange section being higher in density than the remainder of said boss section.

* * * * *